US006224697B1

(12) United States Patent
Mendenhall et al.

(10) Patent No.: US 6,224,697 B1
(45) Date of Patent: May 1, 2001

(54) GAS GENERANT MANUFACTURE

(75) Inventors: Ivan V. Mendenhall, Providence; Robert G. Smith, North Ogden; Robert D. Taylor, Hyrum, all of UT (US)

(73) Assignee: Autoliv Development AB (SE)

( * ) Notice: Subject to any disclaimer, the term of this patent is extended or adjusted under 35 U.S.C. 154(b) by 0 days.

(21) Appl. No.: 09/454,041

(22) Filed: Dec. 3, 1999

(51) Int. Cl.[7] ..... D03D 23/00; C06B 47/08; C06B 31/00

(52) U.S. Cl. ..... 149/109.6; 149/36; 149/45

(58) Field of Search ..... 149/109.6, 45, 149/36; 60/205; 280/741

(56) References Cited

U.S. PATENT DOCUMENTS

| | | |
|---|---|---|
| 2,220,891 | 11/1940 | Cook et al. . |
| 2,904,420 | 9/1959 | Holker . |
| 3,002,830 | 10/1961 | Barr . |
| 3,067,076 | 12/1962 | Butcher et al. . |
| 3,144,367 | 8/1964 | Enoksson . |
| 4,925,600 | 5/1990 | Hommel et al. . |
| 5,053,086 | 10/1991 | Henry et al. . |
| 5,063,036 | 11/1991 | Engel et al. . |
| 5,071,630 | 12/1991 | Oberth . |
| 5,125,684 | 6/1992 | Cartwright . |
| 5,139,588 | 8/1992 | Poole . |
| 5,271,778 | 12/1993 | Bradford et al. . |
| 5,460,668 | 10/1995 | Lyon . |
| 5,472,647 | 12/1995 | Blau et al. . |
| 5,516,377 | 5/1996 | Highsmith et al. . |
| 5,518,054 | 5/1996 | Mitson et al. . |
| 5,529,647 | 6/1996 | Taylor et al. . |
| 5,531,941 | 7/1996 | Poole . |
| 5,542,998 | 8/1996 | Bucerius et al. . |
| 5,542,999 | 8/1996 | Bucerius et al. . |
| 5,545,272 | 8/1996 | Poole et al. . |
| 5,589,661 | 12/1996 | Menke et al. . |
| 5,592,812 | 1/1997 | Hinshaw et al. . |
| 5,596,168 | 1/1997 | Menke et al. . |
| 5,608,183 | 3/1997 | Barnes et al. . |
| 5,641,938 | 6/1997 | Holland et al. . |
| 5,663,524 | 9/1997 | Bucerius et al. . |
| 5,677,510 | 10/1997 | Bucerius et al. . |
| 5,682,014 | 10/1997 | Highsmith et al. . |
| 5,725,699 | 3/1998 | Hinshaw et al. . |
| 5,726,382 | 3/1998 | Scheffee et al. . |
| 5,735,118 | 4/1998 | Hinshaw et al. . |
| 5,747,730 | 5/1998 | Scheffee et al. . |
| 5,780,768 | 7/1998 | Knowlton et al. . |
| 5,783,773 | 7/1998 | Poole . |
| 5,847,315 | 12/1998 | Katzakian, Jr. et al. . |
| 5,850,053 | 12/1998 | Scheffee et al. . |
| 5,866,842 | 2/1999 | Wilson et al. . |

FOREIGN PATENT DOCUMENTS

| | | |
|---|---|---|
| 44 42 169 C1 | 12/1995 | (DE) . |

*Primary Examiner*—Michael J. Carone
*Assistant Examiner*—Aileen J. Baker
(74) *Attorney, Agent, or Firm*—Sally J. Brown

(57) ABSTRACT

A method of making a gas generant formulation which contains a transition metal diammine dinitrate is provided wherein a transition metal nitrate is reacted with an ammonia source to form an aqueous slurry containing a corresponding reaction mixture. A spray dryable precursor to the gas generant formulation is formed including at least a gas generating fuel and a sufficient quantity of water to render the precursor spray dryable. The precursor is subsequently spray dried to form a gas generant powder. The method may also include a relatively mild heat treatment of the dried material, either as a part of the spray drying or subsequent to such spray drying.

30 Claims, No Drawings

GAS GENERANT MANUFACTURE

CROSS REFERENCE TO RELATED APPLICATIONS

The subject matter of this application is related to prior U.S. patent applications Ser. No. 09/124,944, filed on Jul. 30 1998; U.S. Ser. No. 09/221,910, filed on Dec. 28, 1998; U.S. Ser. No. 09/243,161, filed on Feb. 2, 1999; and U.S Ser. No. 09/391,163, filed on Sep. 8, 1999. The disclosures of these related patent applications are each hereby incorporated by reference herein and made a part hereof, including but not limited to those portions which specifically appear hereinafter.

BACKGROUND OF THE INVENTION

This invention relates generally to gas generant materials. More particularly, this invention relates to the manufacture of gas generant formulations such as may be suited for use in the inflation of automotive inflatable restraint airbag cushions.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Upon actuation of the system, the cushion begins to be inflated, in a matter of no more than a few milliseconds, with gas produced or supplied by a device commonly referred to as an "inflator."

While many types of inflator devices have been disclosed in the art for use in the inflating of one or more inflatable restraint system airbag cushions, inflator devices which rely on the combustion of a pyrotechnic, fuel and oxidizer combination or other form of gas generant to produce or at least in part form the inflation gas issuing forth therefrom have been commonly employed in conjunction with vehicular inflatable restraint airbag cushions.

Sodium azide has been a commonly accepted and used gas generating material. While the use of sodium azide and certain other azide-based gas generant materials meets current industry specifications, guidelines and standards, such use may involve or raise potential concerns such as involving one or more of the handling, supply and disposal of such materials.

The development of safe gas generant material alternatives to sodium azide for commercial application in inflatable restraint systems commonly involves the oftentimes conflicting goals or objectives of increasing the gas output of the gas generant material while reducing or minimizing the costs associated with the gas generant material, including the costs associated with ingredients and the processing thereof.

The incorporation and use of ammonium nitrate as an oxidizer in such gas generant formulations has been found to be one generally cost-effective approach for exceeding the current state of the art gas generant formulation gas yield of about 3 moles of gas per 100 grams of gas generant formulation. In particular, ammonium nitrate is relatively inexpensive and, when burned with guanidine nitrate fuel, generally combusts to all gaseous species resulting in gas yields approaching 4 moles of gas per 100 grams of material.

Unfortunately, the general incorporation and use of ammonium nitrate in pyrotechnic gas generant formulations has generally been subject to certain difficulties. For example, ammonium nitrate-containing pyrotechnic gas generant formulations have commonly been subject to one or more of the following shortcomings: low burn rates, burn rates exhibiting a high sensitivity to pressure, as well as to phase or other changes in crystalline structure such as may be associated with volumetric expansion of various forms of such formulations, such as may occur during temperature cycling over the normally expected or anticipated range of storage conditions, e.g., temperatures of about −40° C. to about 11 0° C. Such phase or structural changes may result in physical degradation of the form of the gas generant formulation such as when such gas generant formulation has been shaped or formed into tablets, wafers or other selected shape or form. Further, such changes, even when relatively minute, can strongly influence the physical properties of a corresponding gas generant material and, in turn, strongly affect the bum rate of the generant material. Unless checked, such changes in structure may result in such performance variations in the gas generant materials incorporating such ammonium nitrate as to render the gas generant material unacceptable for typical inflatable restraint system applications.

In view thereof, efforts have been directed to minimizing or eliminating such volume expansion during normal temperature cycling and the effects thereof. In particular, it has been found that the incorporation of a minimum of about 15 wt. % (based on total oxidizer content) of a transition metal diammine dinitrate such as copper diammine dinitrate, nickel diammine dinitrate or zinc diammine dinitrate, for example, in ammonium nitrate, may serve to phase stabilize the mixture and minimize or eliminate volumetric expansion during normal temperature cycling associated with such inflatable restraint applications. Further, ammonium nitrate stabilized with such transition metal diammine dinitrates are typically advantageously less hygroscopic than ammonium nitrate phase stabilized by other methods and the use of such transition metal diammine dinitrates has also been found to result in combustion products which form a more easily filterable clinker.

Ammonium nitrate phase stabilization via the incorporation of such transition metal diammine dinitrates, however, is typically at the cost of an associated reduction in gas yield. For example, the gas yield of a typical formulation containing guanidine nitrate, silicon dioxide (5 wt. %) and ammonium nitrate stabilized with 15 wt. % (based on total oxidizer) of such transition metal diammine dinitrate is about 3.8 moles of gas per 100 grams of gas generant material.

The gas generant formulation incorporation of such transition metal diammine dinitrates at levels greater than 15 wt. % (of the total oxidizer) has been found to increase burn rate and reduce pressure sensitivity of a corresponding gas generant formulation to levels realistic for typical inflatable restraint system applications. The maximum effect on burn rate has been found to generally occur when 100% of the oxidizer is composed of the transition metal diammine dinitrate. The gas yield of a typical formulation containing guanidine nitrate, silicon dioxide (5 wt. %) and such transition metal diammine dinitrate as 100% of the oxidizer is about 3.3 moles of gas per 100 grams of gas generant material, well above the current state of the art gas generant formulation gas yield of about 3 moles of gas per 100 grams of gas generant formulation.

A traditional method of incorporating such a transition metal diammine dinitrate into ammonium nitrate is to react the corresponding metal oxide with ammonium nitrate. For example, for the incorporation of copper diammine dinitrate, cupric oxide and ammonium nitrate can be reacted according to the following reaction:

$$CuO+2\ NH_4NO_3 \Rightarrow Cu(NH_3)_2(NO_3)_2+H_2O \quad (1)$$

This reaction occurs at elevated temperatures (e.g., in excess of 140° C.) in either a solid state reaction or in an ammonium nitrate melt. The rate of such a solid state reaction is temperature dependent and under normal processing conditions (a processing temperature of about 170° C.), such reaction typically requires, dependent on the rate of heat transfer achieved, about 30 minutes to 2 hours to complete. As will be appreciated, such extended processing times typically can render such processing regimes commercially unattractive or infeasible. Further, the conducting of such reaction in an ammonium nitrate melt generally requires specialized equipment since the material would normally have to be melted, reacted, and cooled, returning to a solid form, while simultaneously being granulated. In the case of either such solid state or melt processing regimes, the temperature required to perform such reactions is only about 20° C. to about 30° C. below the temperature at which such corresponding pyrotechnic formulations may begin to decompose. Thus, such processing may not afford a thermal safety margin as sufficiently large as may be desired, particularly for large scale applications. Further, such high temperature heat treatments can constitute an added processing step that may detrimentally affect process economics.

Thus, there is a need and a demand for a method of making a gas generant formulation which contains a transition metal diammine dinitrate which desirably avoids such high temperature processing. In particular, there is a need and a demand for a method of making such a gas generant formulation and which can desirably be implemented within typical or existing processing equipment and such as may be accomplished over a relatively short time period, such as may be desired in commercial applications.

SUMMARY OF THE INVENTION

A general object of the invention is to provide an improved method of making a gas generant formulation which contains a transition metal diammine dinitrate.

A more specific objective of the invention is to overcome one or more of the problems described above.

The general object of the invention can be attained, at least in part, through a method which includes the steps of:

combining at least a nitrate of at least one transition metal with an ammonia source in an aqueous slurry to form a corresponding reaction mixture;

forming a spray dryable precursor to the gas generant formulation, the precursor comprising the aqueous slurry reaction mixture, a gas generant formulation fuel component and a sufficient quantity of water to render the precursor spray dryable; and spray drying the precursor to form a gas generant powder containing a diammine dinitrate of the at least one transition metal.

As detailed below, certain preferred embodiments of the invention may also include a relatively mild heat treatment of the processed material, either as a part of the spray drying or subsequent to such spray drying.

The prior art generally fails to provide a method of making a gas generant formulation which contains a transition metal diammine dinitrate which method desirably avoids high temperature processing such as processing at temperatures undesirably near the decomposition temperature of corresponding pyrotechnic formulations and which method can desirably be implemented within typical or existing processing equipment and/or within relatively short processing time periods.

The invention further comprehends a method of making a gas generant formulation which contains a gas generant fuel component and an oxidizer component comprising at least one transition metal diammine dinitrate selected from the group consisting of copper diammine dinitrate, nickel diammine dinitrate, zinc diammine dinitrate and combinations thereof. In accordance with one preferred embodiment, such method includes the steps of:

combining a quantity of at least one nitrate of a transition metal elected from the group consisting of copper, nickel, zinc and mixtures thereof with a quantity of an ammonia source in an aqueous slurry to form a corresponding reaction mixture, wherein the quantity of the transition metal nitrate and the quantity of the ammonia source are sufficient to provide at least two moles of ammonia per mole of transition metal provided by the quantity of the transition metal nitrate and wherein the ammonia source, upon reaction with the transition metal nitrate produces no by products other than water, one or more volatile gases or a combination thereof;

forming a precursor to a spray dryable gas generant formulation, the precursor comprising the aqueous slurry reaction mixture, additional gas generant formulation components including at least one gas generating fuel material and at least one performance additive selected from the group of aluminum oxide, silicon dioxide and combinations thereof, and a sufficient quantity of water to form a spray dryable gas generant formulation precursor slurry; and spray drying the gas generant formulation precursor slurry to form a gas generant powder; and heating the gas generant powder to a temperature in the range of about 125° C. to about 135° C. to form a gas generant formulation which contains a gas generant fuel component and an oxidizer component comprising a diammine dinitrate of the at least one transition metal.

In accordance with still another embodiment of the invention, a method of making a gas generant formulation which contains a gas generant fuel component and an oxidizer component including at least one transition metal diammine dinitrate selected from the group of copper diammine dinitrate, nickel diammine dinitrate, zinc diammine dinitrate and combinations thereof is provided. Such method includes the step of combining a quantity of at least one nitrate of a transition metal elected from the group consisting of copper, nickel, zinc and mixtures thereof with a quantity of an ammonia source in an aqueous slurry to form a corresponding reaction mixture. In such reaction mixture, the quantity of the transition metal nitrate and the quantity of the ammonia source are sufficient to provide at least two moles of ammonia per mole of transition metal provided by the quantity of the transition metal nitrate. Also, the ammonia source, upon reaction with the transition metal nitrate produces no by products other than water, one or more volatile gases or a combination thereof.

A precursor to a spray dryable gas generant formulation is formed. The precursor includes the aqueous slurry reaction mixture, additional gas generant formulation components including at least one gas generating fuel material and at least one performance additive, and a sufficient quantity of water to form a spray dryable gas generant formulation precursor slurry. In particular, the at least one gas generating fuel material selected from the group consisting of oxygenated nitrogen-containing organic compounds, organic compounds with a high nitrogen content, complexes of at least one transition metal and combinations thereof. The at least one gas generating fuel is included in the precursor in an amount sufficient that about 20 wt. % to about 70 wt. % of the gas generant formulation constitutes such fuel material. The at least one performance additive is preferably selected from the group of aluminum oxide, silicon dioxide and combinations thereof. More particularly, the precursor contains between about 30 wt. % to about 35 wt. % water.

The gas generant formulation precursor slurry is subsequently spray dried to form a gas generant powder. The gas generant powder in turn is heated to a temperature in the range of about 125° C. to about 135° C. to form a heat treated gas generant powder which contains about 30 wt. % to about 60 wt. % of an oxidizer component, wherein the transition metal diammine dinitrate constitutes about 15 wt. % to about 100 wt. % of the oxidizer component.

Other objects and advantages will be apparent to those skilled in the art from the following detailed description taken in conjunction with the appended claims.

DETAILED DESCRIPTION OF THE INVENTION

The present invention provides an improved method of making a gas generant formulation. In particular, the invention provides an improved method of making a gas generant material which contains a transition metal diammine dinitrate and which such gas generant material may desirably be used in the inflation of inflatable devices such as vehicle occupant restraint airbag cushions.

Gas generant materials and formulations prepared in accordance with the invention typically include an oxidizer component including, at least in part, a transition metal diammine nitrate oxidizer material, a gas generating fuel component and, if desired, at least one performance additive such as in the form of a metal oxide such as added to improve either or both slag formation or burn rate properties or qualitites. For example, such improved slag formation can be useful in either or both facilitating retention within an inflator device of certain combustion reaction products whose presence in airbag cushion inflation fluids is generally undesired and providing or resulting in a generally more uniform flow of inflation fluid from such an inflator device. Burn rate property or quality improvements realizable through such additive inclusion include such resulting gas generant materials or formulations exhibiting improved or increased burn rates.

In accordance with certain preferred embodiments of the invention, between about 30 wt. % and about 60 wt. % of the subject gas generant material constitutes such an oxidizer component. In particular, gas generant materials and formulations in accordance with the invention advantageously contain an oxidizer component of which at least 15 wt. % up to about 100 wt. % is composed of a transition metal diammine nitrate oxidizer material, prepared as described herein. Preferred transition metal diammine nitrate oxidizer materials for use in the practice of the invention include copper diammine dinitrate, nickel diammine dinitrate, zinc diammine dinitrate and combinations thereof. If desired, the balance of the oxidizer component of the subject gas generant materials may constitute a suitable supplemental oxidizer material, such as ammonium nitrate in accordance with one preferred embodiment of the invention.

In accordance with a preferred practice of the invention, such transition metal diammine nitrate oxidizer materials are preferably formed during processing in a manner such as avoids or eliminates the need for subsequent high temperature treatment undesirably near the decomposition temperature associated with the such corresponding pyrotechnic formulations. Further, practice of the invention desirably avoids extended durations of heating, such as may be associated with at least certain prior art techniques.

In accordance with the invention, such transition metal diammine dinitrates, such as where the transition metal is selected from the group consisting of copper, nickel, zinc and combinations thereof, have been found to be advantageously formed during a process in which the corresponding transition metal nitrate is combined with an ammonia source in an aqueous slurry such as to form a reaction mixture and which reaction mixture is processed as described herein.

In particular, the metal nitrate can desirably be combined with a stoichiometric amount or more of ammonia from one or more of the following sources: ammonium bicarbonate, ammonium carbonate, ammonium carbamate, ammonium hydroxide, anhydrous ammonia or mixtures thereof, relative to the corresponding metal diammine dinitrate such as in accordance with the following reactions relative to the formation of copper diammine dinitrate:

a) via ammonium bicarbonate, $$Cu(NO_3)_2.2.5\ H_2O+2\ NH_4HCO_3 \Rightarrow Cu(NH_3)_2(NO_3)_2+2CO_2+4.5\ H_2O \quad (2)$$

b) via ammonium carbonate, $$Cu(NO_3)_2.2.5\ H_2O+(NH_4)_2CO_3 \Rightarrow Cu(NH_3)_2(NO_3)_2+CO_2+3.5\ H_2O \quad (3)$$

c) via ammonium carbamate, $$Cu(NO_3)_2.2.5\ H_2O+NH_2CO_2NH_4 \Rightarrow Cu(NH_3)_2(NO_3)_2+CO_2+2.5\ H_2O \quad (4)$$

d) via ammonium hydroxide, $$Cu(NO_3)_2.2.5\ H_2O+2\ NH_4OH \Rightarrow Cu(NH_3)_2(NO_3)_2+4.5\ H_2O \quad (5)$$

e) via anhydrous ammonia, $$Cu(NO_3)_2.2.5\ H_2O+2\ NH_3 \Rightarrow Cu(NH_3)_2(NO_3)_2+2.5\ H_2O \quad (6)$$

Thus, in accordance with a preferred practice of the invention, such reaction mixtures desirably provide or result in at least two moles of ammonia per mole of metal provided by the metal nitrate. Further, while the reactions (2)–(6) have been shown above employing cupric nitrate in the 2.5-hydrate form, the broader practice of the invention is not necessarily limited by the particular hydrate form of the ingredients. For example, similar reactions can be shown employing cupric nitrate trihydrate.

In accordance with certain preferred embodiments of the invention, between about 20 wt. % and about 70 wt. % of the subject gas generant material constitutes such a gas generating fuel component. Preferred fuel materials for use in the practice of the invention are non-azide in nature. Groups or categories of fuels useful in the practice of the invention include one or more various oxygenated nitrogen-containing organic compounds, one or more organic compounds with a high nitrogen content, and one or more complexes of at least one transition metal. Specific examples of oxygenated nitrogen-containing organic compounds useful in the practice of the invention include guanidine nitrate, aminoguanidine nitrate, triaminoguanidine nitrate, nitroguanidine, nitrotriazalone and mixtures thereof. Specific examples of organic compounds with a high nitrogen content useful in the practice of the invention include dicyandiamide, tetrazoles, triazoles and mixtures thereof. Specific examples of transition metal complexes useful in the practice of the invention include transition metal complexes of tetrazoles and triazoles, transition metal nitrate complexes of nitrogen containing organic compounds and mixtures thereof. In particular, such complexes of transition metals such as copper, cobalt, and zinc, for example, can be used. As will be appreciated, the gas generating fuel component of particular gas generant compositions in accordance with the invention may be comprised of individual such fuel materials or combinations thereof.

Gas generant materials or formulations prepared in accordance with the invention may additionally desirably contain one or more performance additives such as in the form of a metal oxide such as added to improve either or both slag formation or burn rate properties or qualitites. Particular examples of suitable such performance additives are aluminum oxide and silicon dioxide. In practice, such additives may desirably be included in relative amounts of between about 2 wt. % and about 10 wt. % of the gas generant formulation. The incorporation and use of such silicon and aluminum oxide materials are particularly effective in facilitating the production of a slag material which is relatively easily filtered from the gas stream of an airbag inflator.

In accordance with the invention, such gas generant formulations can desirably be made via a method which includes combining a transition metal nitrate with an ammonia source in an aqueous slurry to form a reaction mixture, such as described above, and forming a spray dryable precursor to the gas generant formulation, the precursor including the aqueous slurry reaction mixture, desired additional gas generant formulation components including at least a gas generating fuel and a sufficient quantity of water to render the precursor spray dryable. While the broader practice of the invention is not limited by the specific amount of water added during such processing, it has been found generally desirable that water be added in sufficient quantity that the spray dryable gas generant formulation precursor slurry contains between about 30 wt. % and about 35 wt. % water.

It will be appreciated that various processing arrangements are available whereby such a spray dryable precursor can be formed or arrived at. For example, in accordance with one embodiment of the invention, such spray dryable precursor is formed via the above-identified aqueous slurry reaction mixture being prepared such as to contain the desired quantity of water to render the precursor spray dryable. Alternatively, an additional quantity of water may be required to be added to the aqueous slurry reaction mixture to render a spray dryable precursor.

In accordance with one preferred practice of the invention, it is generally desirable that additional gas generant formulation components such as either or both a gas generating fuel material and, if used, a performance additive, such as described above, be added to the above-identified aqueous slurry reaction mixture, such as after completion of reaction of the combined transition metal nitrate and ammonia source, such as evidenced by the completion of the evolution of carbon dioxide therefrom, as described in greater detail below in connection with certain of the examples herein provided. Such post-reaction addition is generally preferred as the possibility of undesired reaction between one or more of such additional gas generant formulation components, either alone or in combination with either or both the transition metal nitrate and ammonia source can accordingly be avoided or limited.

The spray dryable precursor can then be appropriately spray dried, in a manner such as is known in the art and so as to form a gas generant powder containing a diammine dinitrate of the at least one transition metal.

Following such spray drying and as detailed below in the examples, a relatively minor or mild heat treatment (i.e., heating of the material to a temperature of no more than about 135° C., e.g., a temperature of approximately 125–130° C. and holding the heated material at that temperature for a duration of at least approximately 5 minutes) of the material resulting upon such spray drying, may be desired or required in order to ensure or complete conversion of the transition metal species to the desired transition metal diammine dinitrate and such has been found to remain in a stable form.

The application of more severe heat treatment processing (i.e., processing involving either or both heating the material to a higher temperature, such as a temperature in excess of or greater than 135° C., or for significantly longer periods of time, such as for durations of 10 minutes or more) is generally not preferred or desired. In particular, such more severe heat treatment processing generally has associated therewith correspondingly higher processing costs without necessarily providing or resulting in concomitant processing or product benefits or improvements.

Those skilled in the art and guided by the teachings herein provided will appreciate that post-spray dry heating can desirably be avoided where, for example, sufficient heat treatment is achieved or realized during the drying process. Alternatively, however, such heating can be relatively easily implemented into a processing scheme such as via in-line fluid bed dryers such as may be incorporated between a spray dry tower and an associated collection bin, for example. In either case, such heat treatment is generally either or both at significantly lower processing temperatures or for significantly shorter durations than associated with prior art processing techniques.

The resulting gas generant powder can be appropriately processed or shaped, such as by being tableted or watered, for example and is generally known in the art, and such as may be desired for particular applications of such a gas generant formulation.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1

A 100-gram laboratory scale sample of a gas generant formulation was prepared containing copper diammine dinitrate (CDDN) prepared in accordance with the invention. More specifically, the copper diammine dinitrate (CDDN) was formed by reacting cupric nitrate with ammonium bicarbonate using the following procedure: Cupric nitrate 2.5-hydrate (54.51 grams) and ammonium bicarbonate (37.04 grams) powders were blended and heated to 40° C. The powders reacted and liberated water, which liquefied the mixture. Carbon dioxide gas, also formed upon reaction of the cupric nitrate 2.5-hydrate and ammonium bicarbonate, bubbled out of the reaction mixture. The temperature was maintained at 40° C. until all the carbon dioxide gas had evolved.

At which time, guanidine nitrate (GN) fuel (in an amount of 42.95 grams), silicon dioxide (5.10 grams) and sufficient additional water (23.87 grams) to render the resulting mixture spay dryable (c.a., 30 wt. % water) were stirred into the reaction mixture. While the resulting mix was spray dryable, for purposes of this laboratory formulation, the mix was vacuum dried at 80° C. When the moisture level reached approximately 5 wt. %, the mix was granulated then completely dried. In the dried formulation, the CDDN appeared to be disproportionated into copper tetrammine dinitrate (CTDN) and an unidentified light-blue copper species. Application of heat (i.e., heating the dried formulation to a temperature of approximately 125–130° C. and holding the heated formulation at that temperature for approximately 5 minutes) converted the mixture of copper species into CDDN which remained in a stable form.

The resulting gas generant material was analyzed and then compared and tested relative to a similar gas generant formulation containing CDDN which was prepared by the traditional method of reacting cupric oxide with ammonium nitrate (i.e., COMPARATIVE EXAMPLE 1). The result of the analysis and testing is shown in TABLE 1, below.

TABLE 1

| | EXAMPLE 1 (wt. %) | COMP. EX. 1 (wt. %) |
|---|---|---|
| ANALYSIS | | |
| guanidine nitrate | 42.10 | 40.20 |
| $NH_3$ | 7.23 | 7.76 |
| total copper | 14.62 | 14.13 |
| carbon | 4.25 | 4.21 |
| BURN RATE | | |
| @ 1000 psi (ips) | 0.41 | 0.59 |
| slope | 0.56 | 0.53 |
| constant | 0.008 | 0.015 |

Discussion of Results

An analytical comparison of the gas generant material of EXAMPLE 1 with the gas generant material of COMPARATIVE EXAMPLE 1 showed that these gas generant materials exhibited similar safety test values (e.g., similar impact, friction, electrostatic discharge (ESD) and thermal stability (as measured via Modified Bulk Autoignition Testing (MBAT) values) as well as similar thermal analysis (e.g., similar Differential Scanning Calorimetry (DSC) and Thermal Gravimetric Analysis (TGA). Further, while the gas generant material of EXAMPLE 1 exhibited a lower burn rate as compared to the gas generant material of COMPARATIVE EXAMPLE 1, such lower burn rate is believed attributable to the material of EXAMPLE 1 having been a laboratory beaker gas generant preparation. Laboratory beaker gas generant preparations have consistently exhibited lower burn rates as compared to similar spray dried formulations.

Examples 2–4

In these Examples, gas generant formulations similar to that of EXAMPLE 1 were prepared but now using the alternative ammonia sources of ammonium carbonate, ammonium carbamate, and ammonium hydroxide (28 wt. %), respectively, in place of ammonium bicarbonate, in accordance with TABLE 2, below.

In particular, in Examples 2 and 3 (i.e., EX 2 and EX 3, respectively), the formulations were prepared in a manner similar to EXAMPLE 1, described above, except now employing ammonium carbonate and ammonium carbamate, respectively.

In EXAMPLE 4 (EX 4), copper nitrate was stirred into the ammonium hydroxide and no carbon dioxide was evolved. The remaining ingredients were added in a manner similar to that of EXAMPLE 1, described above.

Example 5

In this Example (EX 5), a gas generant formulation similar to that of EXAMPLE 1 is prepared but now using the alternative ammonia source of anhydrous ammonia, in place of ammonium bicarbonate, in accordance with TABLE 2, below. In particular, ammonia gas is bubbled into an aqueous solution of copper nitrate and no carbon dioxide is evolved. The remaining ingredients are then added in a manner similar to that of EXAMPLE 1, described above.

TABLE 2

| EX | Ammonia Source-(g) | GN (g) | $SiO_2$ (g) | $Cu(NO_3)_2.2.5H_2O$(g) | $H_2O$ (g) |
|---|---|---|---|---|---|
| 2 | $(NH_4)_2CO_3$ 22.50 | 42.95 | 5.10 | 54.51 | 28.09 |
| 3 | $NH_2CO_2NH_4$ 18.30 | 42.95 | 5.10 | 54.51 | 32.31 |
| 4 | $NH_4OH$(28 wt. %) 28.46 | 42.95 | 5.10 | 54.51 | 11.82 |
| 5 | $NH_3$ 7.97 | 42.95 | 5.10 | 54.51 | 32.31 |

Thus, the invention provides a method of making a gas generant formulation which contains a transition metal diammine dinitrate which method can desirably be implemented within typical or existing processing equipment and which method desirably avoids high temperature processing such as processing at temperatures undesirably near the decomposition temperature of corresponding pyrotechnic formulations. Further, the invention provides a method of making such a gas generant formulation such as desirably may be accomplished over a relatively short time period, such as may be desired in various commercial applications.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method of making a gas generant formulation which contains a transition metal diammine dinitrate, the method comprising the steps of:

combining at least a nitrate of at least one transition metal with an ammonia source in an aqueous slurry to form a corresponding reaction mixture;

forming a spray dryable precursor to the gas generant formulation, the precursor comprising the aqueous slurry reaction mixture, a gas generant formulation fuel component and a sufficient quantity of water to render the precursor spray dryable; and spray drying the precursor to form a gas generant powder containing a diammine dinitrate of the at least one transition metal.

2. The method of claim 1 additionally comprising the step of:

heat treating the gas generant powder.

3. The method of claim 2 wherein the heat treating step comprises heating the gas generant powder to a temperature no more than about 135° C.

4. The method of claim 1 wherein:

the transition metal of the transition metal nitrate is selected from the group consisting of copper, nickel, zinc and combinations thereof.

5. The method of claim 1 wherein:

the ammonia source reacts with the transition metal nitrate to produce no by-products other than water, one or more volatile gases or a combination thereof.

6. The method of claim 5 wherein:

the ammonia source is selected from the group consisting of ammonium bicarbonate, ammonium carbonate, ammonium carbamate, ammonium hydroxide, anhydrous ammonia or mixtures thereof.

7. The method of claim 1 wherein:

the precursor is formed to contain sufficient quantities of the transition metal nitrate and the ammonia source to provide at least two moles of ammonia per mole of transition metal provided by the quantity of the transition metal nitrate.

8. The method of claim 1 wherein the gas generating fuel component comprises an oxygenated nitrogen-containing organic compound.

9. The method of claim 8 wherein the gas generating fuel oxygenated nitrogen-containing organic compound is selected from the group consisting of guanidine nitrate, aminoguanidine nitrate, triaminoguanidine nitrate, nitroguanidine, nitrotriazalone and mixtures thereof.

10. The method of claim 1 wherein the gas generating fuel component comprises an organic compound with a high nitrogen content.

11. The method of claim 10 wherein the gas generating fuel organic compound with a high nitrogen content is selected from the group consisting of dicyandiamide, tetrazoles, triazoles and mixtures thereof.

12. The method of claim 1 wherein the gas generating fuel component comprises a complex of at least one transition metal.

13. The method of claim 12 wherein the gas generating fuel transition metal complex is selected from the group consisting of transition metal complexes of tetrazoles and triazoles, transition metal nitrate complexes of nitrogen containing organic compounds and mixtures thereof.

14. The method of claim 1 wherein the precursor is formed to include the gas generating fuel component in an amount sufficient that the gas generating fuel comprises about 20 wt. % to about 70 wt. % of the transition metal diammine dinitrate-containing gas generant powder.

15. The method of claim 1 wherein the transition metal diammine dinitrate-containing gas generant powder comprises an oxidizer component constituting about 30 wt. % to about 60 wt. % of the formulation.

16. The method of claim 15 wherein the transition metal diammine dinitrate constitutes about 15 wt. % to about 100 wt. % of the oxidizer component.

17. The method of claim 16 wherein the precursor is formed to additionally include ammonium nitrate and wherein the oxidizer component additionally comprises ammonium nitrate.

18. The method of claim 1 wherein the precursor is formed to additionally include at least one performance additive and the transition metal diammine dinitrate-containing gas generant powder additionally includes the at least one performance additive.

19. The method of claim 18 wherein the at least one performance additive is selected from the group of aluminum oxide, silicon dioxide and combinations thereof.

20. The method of claim 1 wherein the precursor is formed to contain between about 30 wt. % and about 35 wt. % water.

21. A method of making a gas generant formulation which contains a gas generant fuel component and an oxidizer component comprising at least one transition metal diammine dinitrate selected from the group consisting of copper diammine dinitrate, nickel diammine dinitrate, zinc diammine dinitrate and combinations thereof, the method comprising the steps of:

combining a quantity of at least one nitrate of a transition metal elected from the group consisting of copper, nickel, zinc and mixtures thereof with a quantity of an ammonia source in an aqueous slurry to form a corresponding reaction mixture, wherein the quantity of the transition metal nitrate and the quantity of the ammonia source are sufficient to provide at least two moles of ammonia per mole of transition metal provided by the quantity of the transition metal nitrate and wherein the ammonia source, upon reaction with the transition metal nitrate produces no by products other than water, one or more volatile gases or a combination thereof;

forming a precursor to a spray dryable gas generant formulation, the precursor comprising the aqueous slurry reaction mixture, additional gas generant formulation components including at least one gas generating fuel material and at least one performance additive selected from the group of aluminum oxide, silicon dioxide and combinations thereof, and a sufficient quantity of water to form a spray dryable gas generant formulation precursor slurry; and spray drying the gas generant formulation precursor slurry to form a gas generant powder; and heating the gas generant powder to a temperature in the range of about 125° C. to about 135° C. to form a gas generant formulation which contains a gas generant fuel component and an oxidizer component comprising a diammine dinitrate of the at least one transition metal.

22. The method of claim 21 wherein the ammonia source is selected from the group consisting of ammonium bicarbonate, ammonium carbonate, ammonium carbamate, ammonium hydroxide, anhydrous ammonia or mixtures thereof.

23. The method of claim 21 wherein the at least one gas generating fuel material is selected from the group consisting of oxygenated nitrogen-containing organic compounds, organic compounds with a high nitrogen content, complexes of at least one transition metal and combinations thereof.

24. The method of claim 21 wherein the precursor is formed to include the gas generating fuel component in an amount sufficient that the gas generating fuel comprises about 20 wt. % to about 70 wt. % of the gas generant formulation.

25. The method of claim 21 wherein the gas generant formulation comprises an oxidizer component constituting about 30 wt. % to about 60 wt. % of the formulation.

26. The method of claim 25 wherein the transition metal diammine dinitrate constitutes about 15 wt. % to about 100 wt. % of the oxidizer component.

27. The method of claim 21 wherein the precursor is formed to additionally include ammonium nitrate and wherein the oxidizer component additionally comprises ammonium nitrate.

28. The method of claim 21 wherein the precursor is formed to contain between about 30 wt. % and about 35 wt. % water.

29. A method of making a gas generant formulation which contains a gas generant fuel component and an oxidizer component comprising at least one transition metal diammine dinitrate selected from the group consisting of copper diammine dinitrate, nickel diammine dinitrate, zinc diammine dinitrate and combinations thereof, the method comprising the steps of:

combining a quantity of at least one nitrate of a transition metal elected from the group consisting of copper, nickel, zinc and mixtures thereof with a quantity of an ammonia source in an aqueous slurry to form a corresponding reaction mixture, wherein the quantity of the transition metal nitrate and the quantity of the ammonia source are sufficient to provide at least two moles of ammonia per mole of transition metal provided by the quantity of the transition metal nitrate and wherein the ammonia source, upon reaction with the transition metal nitrate produces no by products other than water, one or more volatile gases or a combination thereof;

forming a precursor to a spray dryable gas generant formulation, the precursor comprising the aqueous slurry reaction mixture, additional gas generant formulation components including a sufficient amount of at least one gas generating fuel material selected from the group consisting of oxygenated nitrogen-containing organic compounds, organic compounds with a high nitrogen content, complexes of at least one transition metal and combinations thereof whereby about 20 wt. % to about 70 wt. % of the gas generant formulation constitutes such fuel material and at least one performance additive selected from the group of aluminum oxide, silicon dioxide and combinations thereof, and a sufficient quantity of water to form a spray dryable gas generant formulation precursor slurry containing between about 30 wt. % to about 35 wt. % water;

spray drying the gas generant formulation precursor slurry to form a gas generant powder; and heating the gas generant powder to a temperature in the range of about 125° C. to about 135° C. to form a heat treated gas generant powder comprising about 30 wt. % to about 60 wt. % of an oxidizer component, wherein the transition metal diammine dinitrate constitutes about 15 wt. % to about 100 wt. % of the oxidizer component.

30. The method of claim 29 wherein the oxidizer component additionally comprises ammonium nitrate and wherein the precursor is formed to include ammonium nitrate.

* * * * *